US010391514B2

(12) United States Patent
Zolli et al.

(10) Patent No.: US 10,391,514 B2
(45) Date of Patent: Aug. 27, 2019

(54) COATING APPLICATION WITH AUTOMATED BRUSHING

(71) Applicant: Toyota Motor Engineering & Manufacturing North America, Inc., Erlanger, KY (US)

(72) Inventors: Frank Zolli, Brantford (CA); Dan LeLievre, Cambridge (CA); Michael Horn, Kitchener (CA)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 0 days.

(21) Appl. No.: 15/628,980

(22) Filed: Jun. 21, 2017

(65) Prior Publication Data

US 2018/0369854 A1 Dec. 27, 2018

(51) Int. Cl.

| | |
|---|---|
| ***B05C 1/02*** | (2006.01) |
| ***B05C 1/06*** | (2006.01) |
| ***B05C 5/02*** | (2006.01) |
| ***B05C 9/12*** | (2006.01) |
| ***B44D 3/12*** | (2006.01) |
| ***A46B 17/06*** | (2006.01) |

(Continued)

(52) U.S. Cl.

CPC ..... *B05C 1/06* (2013.01); *B05C 1/027* (2013.01); *B44D 3/128* (2013.01); *A46B 17/06* (2013.01); *B05B 1/005* (2013.01); *B05C 5/0216* (2013.01); *B05C 9/12* (2013.01); *B05C 17/10* (2013.01)

(58) Field of Classification Search

CPC ..... B05C 1/06; B05C 1/027; B05C 1/0817; B05C 5/0216; B05C 5/0295; B05C 9/12; B05C 11/11; B05C 17/10; B05B 1/005; B44D 3/125; B44D 3/128; B44D 3/123; B44D 3/006; A46B 17/06; A45D 34/046

USPC ..... 118/304, 313, 300, 266, 264, 665, 696, 118/712; 901/43; 427/429, 427.2, 427.3; 206/209, 361, 15.2, 15.3; 220/695; D9/906, 447, 434; D32/53, 53.1; 134/900; 15/21.1, 38, 53.1

See application file for complete search history.

(56) References Cited

U.S. PATENT DOCUMENTS

| | | | | |
|---|---|---|---|---|
| 5,429,682 A | | 7/1995 | Harlow et al. | |
| 6,041,919 A | * | 3/2000 | Adams | A45D 34/046 206/15.2 |

(Continued)

FOREIGN PATENT DOCUMENTS

| | | |
|---|---|---|
| CN | 104989083 A | 10/2015 |
| EP | 838403 A1 | 4/1998 |

(Continued)

*Primary Examiner* — Laura Edwards

(74) *Attorney, Agent, or Firm* — Christopher G. Darrow; Darrow Mustafa PC

(57) ABSTRACT

Arrangements described herein include coating application systems and methods for controlling such systems. The system can include an application end configured to be operatively connected to a robot arm. The application end can include one or more nozzles to dispense a coating onto a workpiece. The application end can further include one or more brushes to brush a portion of the coating dispensed onto the workpiece. The brush can be moveable between a retracted position and a deployed position. In some arrangements, the systems can include a cleaning tool to remove excess coating from the brush after brushing.

17 Claims, 5 Drawing Sheets

(51) Int. Cl.
*B05C 17/10* (2006.01)
*B05B 1/00* (2006.01)

(56) References Cited

U.S. PATENT DOCUMENTS

| | | | | |
|---|---|---|---|---|
| D473,790 | S * | 4/2003 | Nottingham | D9/434 |
| 7,077,020 | B2 | 7/2006 | Langley et al. | |
| 9,468,287 | B1 * | 10/2016 | Barnard | A46B 17/06 |
| 10,086,398 | B2 * | 10/2018 | Akaishi | B05B 13/0431 |
| 2014/0075695 | A1 | 3/2014 | Kleiner et al. | |

FOREIGN PATENT DOCUMENTS

| | | | |
|---|---|---|---|
| GB | 2182267 | * | 5/1987 |
| KR | 20120105807 | * | 9/2012 |
| WO | WO-2015/145951 | * | 10/2015 |

* cited by examiner

COATING APPLICATION WITH AUTOMATED BRUSHING

FIELD

The subject matter described herein relates in general to the application of coating materials and, more particularly, to the automated dispensing and brushing of a coating.

BACKGROUND

During vehicle manufacturing or assembly, a variety of coatings, such as sealers, insulators, and/or paint, can be applied to one or more workpieces. For example, an underbody coating can be applied to seams between multiple components of an underbody assembly for a vehicle. In some cases, the coating can be applied via an automated process utilizing robotics. The coating is typically inspected manually. In certain areas, manual brushing of the applied underbody coating is required. For instance, areas in which there is a gap in coverage of the coating, or too much coating is present, can be manually brushed.

SUMMARY

In one respect, the subject matter described herein relates to a method of applying a coating to a workpiece via a coating system. The coating system includes a robot arm operatively connected to an application end. The application end has a nozzle and a brush. The brush is moveable between a retracted position and a deployed position. The method includes causing a coating to be dispensed by the nozzle onto the workpiece. The method further includes causing the brush to move from the retracted position to the deployed position. The method includes brushing, using the brush, a portion of the coating dispensed onto the workpiece.

In another respect, the subject matter described herein relates to an application end for a robot arm to apply a coating to a workpiece. The application end includes a nozzle configured to dispense the coating onto the workpiece. The application end also includes a brush configured to brush a portion of the coating dispensed onto the workpiece. The brush is moveable between a retracted position and a deployed position. The brush is positioned farther away from the nozzle in a longitudinal direction in the deployed position than in the retracted position.

In yet another respect, the subject matter described herein relates to a system to apply a coating to a workpiece. The system includes a robot arm and an application end operatively connected to the robot arm. The application end includes a nozzle configured to dispense the coating onto the workpiece. The application end also includes a brush configured to brush a portion of the coating dispensed onto the workpiece. The brush is moveable between a retracted position and a deployed position. The brush is positioned farther away from the nozzle in a longitudinal direction in the deployed position than in the retracted position.

DETAILED DESCRIPTION

Figure 1:
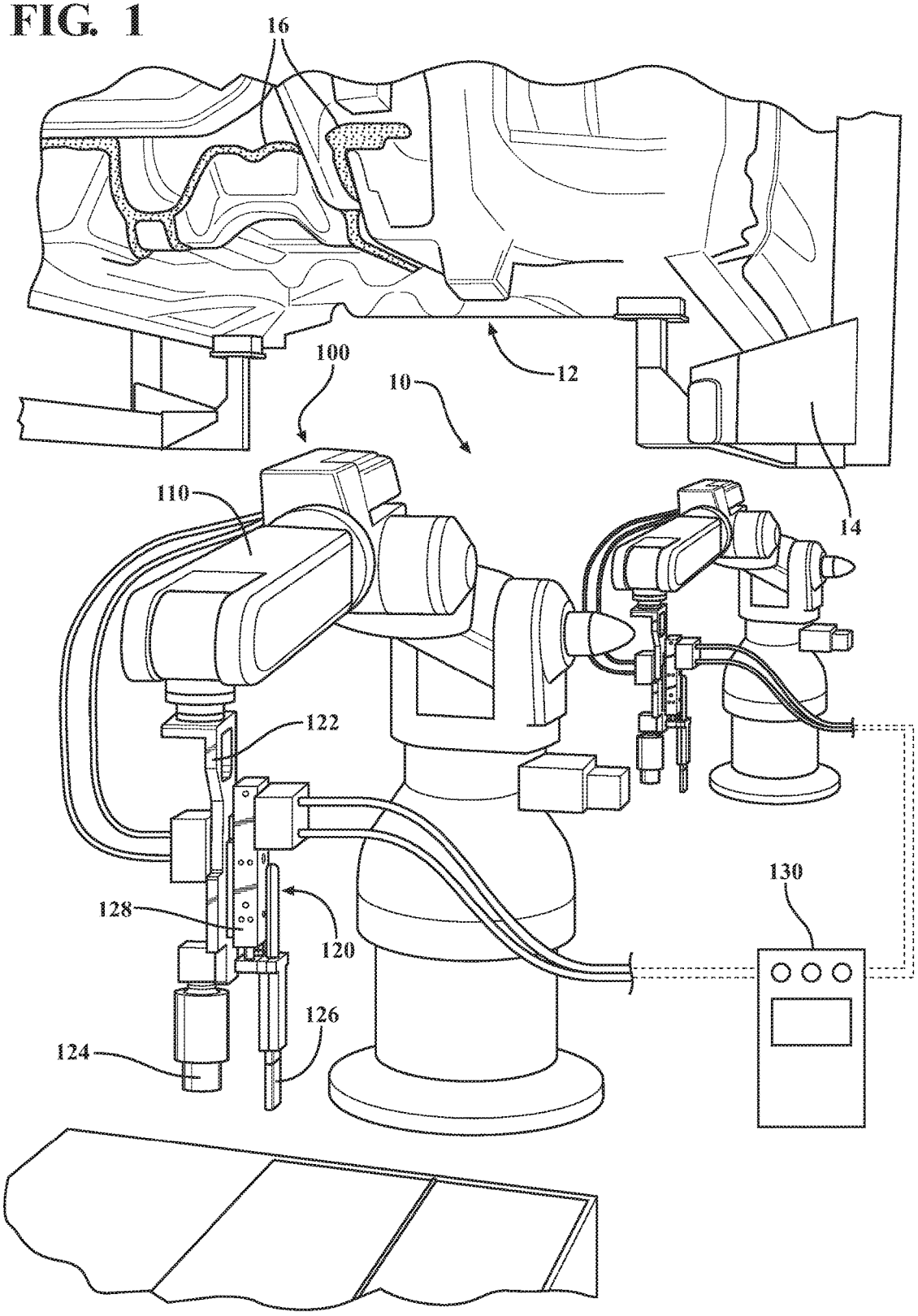
FIG. 1 shows an example manufacturing station having a coating system with a coating application end.

This detailed description relates to systems to apply a coating and methods for controlling such systems. Arrangements described herein can include application ends that are operatively connected to robotics to apply a coating to a workpiece. The application ends can include one or more nozzles to dispense the coating onto the workpiece. The application ends can further include one or more brushes to brush a portion of the coating that is dispensed onto the workpiece. Arrangements described herein can include brushes that are moveable between retracted positions for dispensing and deployed positions for brushing. Some systems can include one or more cleaning tools which can remove excess coating from the brush after brushing. The present detailed description relates to apparatuses, systems, and/or methods that incorporate one or more such features. In at least some instances, arrangements described herein can reduce manufacturing complexity, automate the brushing of a coating/workpiece, reduce manual input, and reduce down time between operations.

Detailed embodiments are disclosed herein; however, it is to be understood that the disclosed embodiments are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various embodiments are shown in FIGS. 1-6, but the embodiments are not limited to the illustrated structure or application.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details.

FIG. 1 shows an example of a coating system 100 within a manufacturing station 10. As used herein, "station" can include any physical area in which a manufacturing and/or assembly process takes place. The station 10 can be one station in a series of stations, such as within an assembly plant. A workpiece 12 can be present within the station 10. The workpiece 12 can include any structure. In one or more arrangements, the workpiece 12 can be portions of a pre-assembled vehicle. As used herein, "vehicle" means any form of motorized transport. In one or more implementations, the vehicle can be an automobile. For example, the workpiece 12 can be an underbody assembly of a vehicle.

The workpiece 12 can be positioned in any suitable location within the station 10. In one or more arrangements, the underbody workpiece 12 can be held by a conveyor support 14. The conveyor support 14 can allow movement of the workpiece 12 through multiple stations as well as retain the workpiece 12 at an elevational location above a floor area of the station 10. In one or more arrangements, the conveyor support 14 can retain the workpiece 12 above elements of the system 100, such as one or more robots. The workpiece 12 can remain stationary within the station 10. Alternatively or in addition, the workpiece can be moved relative to one or more elements of the system 100. For example, the conveyor support 14 can move the workpiece 12 into and out of the station 10.

In one or more arrangements, the coating system 100 can be at least partially located within the station 10. Some of the possible elements of the coating system 100 (also referred to as simply "the system 100") are shown in FIGS. 1-5 and will now be described. It will be understood that it is not necessary for the system 100 to have all of the elements shown in the Figures or described herein. The system 100 can have any combination of the various elements shown and described. Further, the system 100 can have additional elements to those shown and described. In some arrangements, the system 100 may not include one or more of the elements shown in the Figures.

As shown in FIG. 1, the system 100 can include one or more robot arms 110. The robot arm(s) 110 can be any type of mechanical arm that allows motion of a free end (such as the application end 120 described below). The robotic arm(s) 110 can include one or more links that can be manipulated relative to one another. The links can be connected by joints that allow rotational and/or translational movement. In one or more arrangements, movement of the root arm(s) 110 can be programmable.

In one or more arrangements, the system 100 can include one or more end effectors operatively connected to the free end of the robot arm(s) 110. The term "operatively connected," as used throughout this description, can include direct or indirect connections, including connections without direct physical contact. The end effector(s) can be configured to interact with the environment within the station 10.

The end effector(s) can include one or more coating application ends 120. The application end(s) 120 can be configured to apply a coating 16 to the workpiece 12. As used herein, "coating" includes any covering that can be applied to a surface of the workpiece 12. In some arrangements, the coating 16 can be a fluid having any suitable viscosity. The coating can be decorative and/or functional. In one or more arrangements, the coating can be an underbody coating (UBC) that is applied to an underbody assembly of a vehicle. The UBC can be a polyvinyl chloride (PVC) based material. As shown in FIG. 1, a coating 16 can be applied to the underbody assembly at one or more seams between two components. In some arrangements, the coating 16 can provide a seal between two components. For example, the UBC can provide a waterproof and/or water resistant seal between components of the underbody assembly. It is to be appreciated that the coating 16 can include other coatings, such as sealers, paint, and/or adhesives.

The application end(s) 120 can include a base 122. The base 122 can be operatively connected to the robot arm 110. The base 122 can have any suitable configuration to allow operative connection with one or more elements. For example, the base 122 can be operatively connected to one or more nozzles 124 and/or one or more brushes 126. The base 122 can have attachment features, such as fasteners, apertures, clips, and/or adhesives.

The application end 120 can include one or more nozzles 124 to dispense the coating 16. The nozzle(s) 124 can have any suitable configuration and be operatively connected to the base 122. In some arrangements, the nozzle(s) 124 can be configured to dispense a UBC in a swirl pattern. The nozzle(s) 124 can be in fluid communication with the coating 16 via one or more conduits. For example, the coating 16 can be stored in a storage area (not shown) and conveyed to the nozzle(s) 124 via the conduit(s). In one or more arrangements, the movement of the nozzle(s) 124 can be controlled via the robotic arm 110. The movement of the nozzle(s) 124 and/or the dispensing of the coating 16 can be programmable.

The application end 120 can include one or more brushes 126 to brush the coating 16. As used herein, "brushing" can include any direct contact between the brush 126 and the coating 16 and/or the workpiece 12. For example, the brush 126 can brush the coating 16 by moving along, and directly contacting, the coating 16 dispensed onto the workpiece 12 via the nozzle(s) 124. In some arrangements, the brush 126 can brush the coating 16 by contacting the coating 16 via a layer of excess coating on the brush 126. In one or more arrangements, the movement of the brush(es) 126 can be controlled via the robotic arm 110. The movement of the brush(es) 126 can be programmable.

The brush 126 can have any suitable configuration and be operatively connected to the base 122. The brush 126 can include bristles, wire, and/or other filaments. The brush 126 can be formed from any suitable material. For example, the brush 126 can be formed from a plurality of metal fibers. As described in further detail below, the brush 126 can be operatively connected to the base 122 via one or more actuators 128.

Figure 2B:
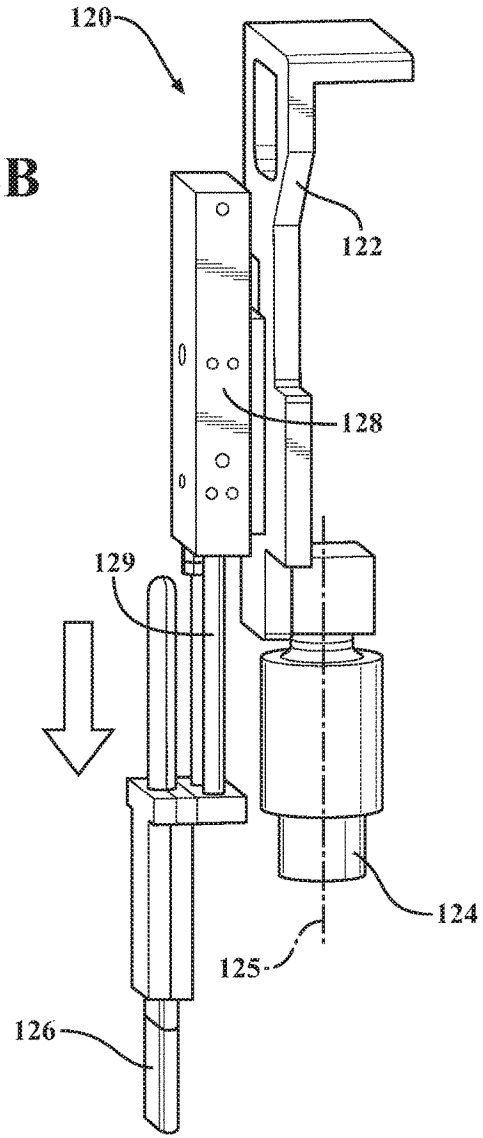
FIG. 2B shows the application end of the coating system of FIG. 1 where the brush is in an extended position.
Figure 2A:
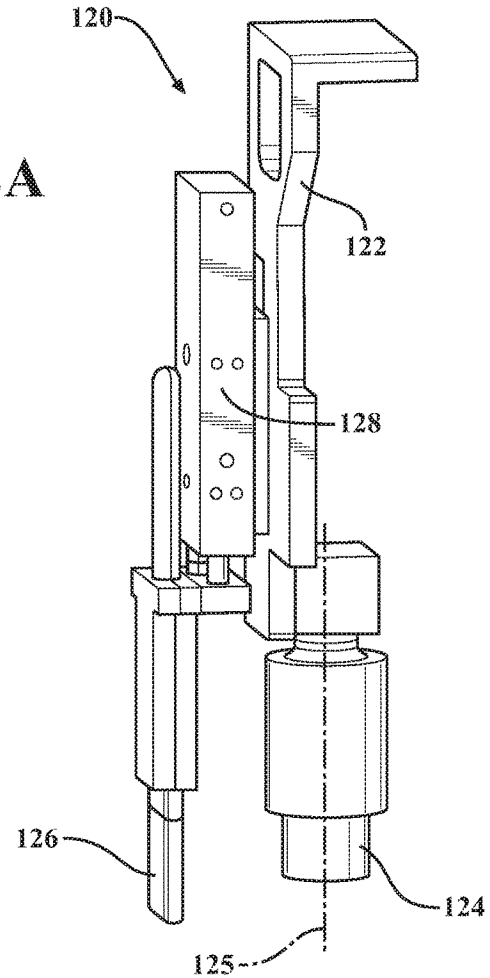
FIG. 2A shows the application end of the coating system of FIG. 1 where a brush is in a retracted position.

In one or more arrangements, the brush 126 can be configured to move between a retracted position and a deployed position. FIGS. 2A and 2B show the brush 126 of the application end 120 in the retracted position and the deployed position, respectively. In some arrangements, when in the retracted position, the brush 126 can be located close to a dispensing end of the nozzle 124. For example, the brush 126 can be positioned at a similar distance away from the base 122 as the nozzle 124 in the direction of a longitudinal axis 125 of the nozzle 124. In the retracted position, the brush 126 can be positioned as to not interfere with the dispensing of the coating 16 by the nozzle(s) 124.

With reference to FIG. 2B, the application end 120 can be shown when the brush 126 is in a deployed position. In the deployed position, the brush 126 can be positioned farther from the nozzle 124 in the direction of the longitudinal axis 125. For example, the brush 126 can be positioned farther from the dispensing end of the nozzle than in the retracted position. In some arrangements, the deployed position can allow the brush 126 to brush hard-to-reach areas of the workpiece 12 without causing the nozzle(s) 124 to contact the workpiece 12.

The brush 126 can be moved into and out of the retracted position and/or the deployed position in any suitable manner. In one example, the brush 126 can be extended in a substantially linear manner. For example, the brush 126 can be moved via an actuator 128 in a substantially linear direction. For example, the brush 126 can be moved in a direction substantially parallel to the longitudinal axis 125. The actuator 128 can be any suitable linear actuator. For example, the actuator 128 can include mechanical, pneumatic, hydraulic, piezoelectric, and/or mechanical and electrical hybrid actuators. The actuator 128 can be operatively connected to the base 122 and the brush 126 via a piston 129. In some arrangements, the piston 129 is configured to be moved by the actuator 128. For example, the actuator can be pneumatic, and the piston 129 can be moved via air pressure. The actuator 128 can be activated responsive to receiving signals or other inputs from one or more system 100 sources. For example, the actuator 128 can be activated in response to an electrical signal, such as a 20 volt direct current (20 VDC) signal.

However, it will be appreciated that the use of the actuator 128 is merely one example of a manner in which the brush 126 can be caused to move into and out of the retracted position and/or the deployed position. For instance, in some arrangements, the brush 126 can be moved by one or more rollers, one or more wheels, one or more sliders, one or more ball bearings, and/or one or more magnets, just to name a few possibilities. Further, the brush 126 can be moved rotationally instead of, or in addition to, being moved in a linear direction. For example, the brush 126 can rotate relative to the base 122 as it moves from the retracted position to/from the deployed position.

Figure 3:
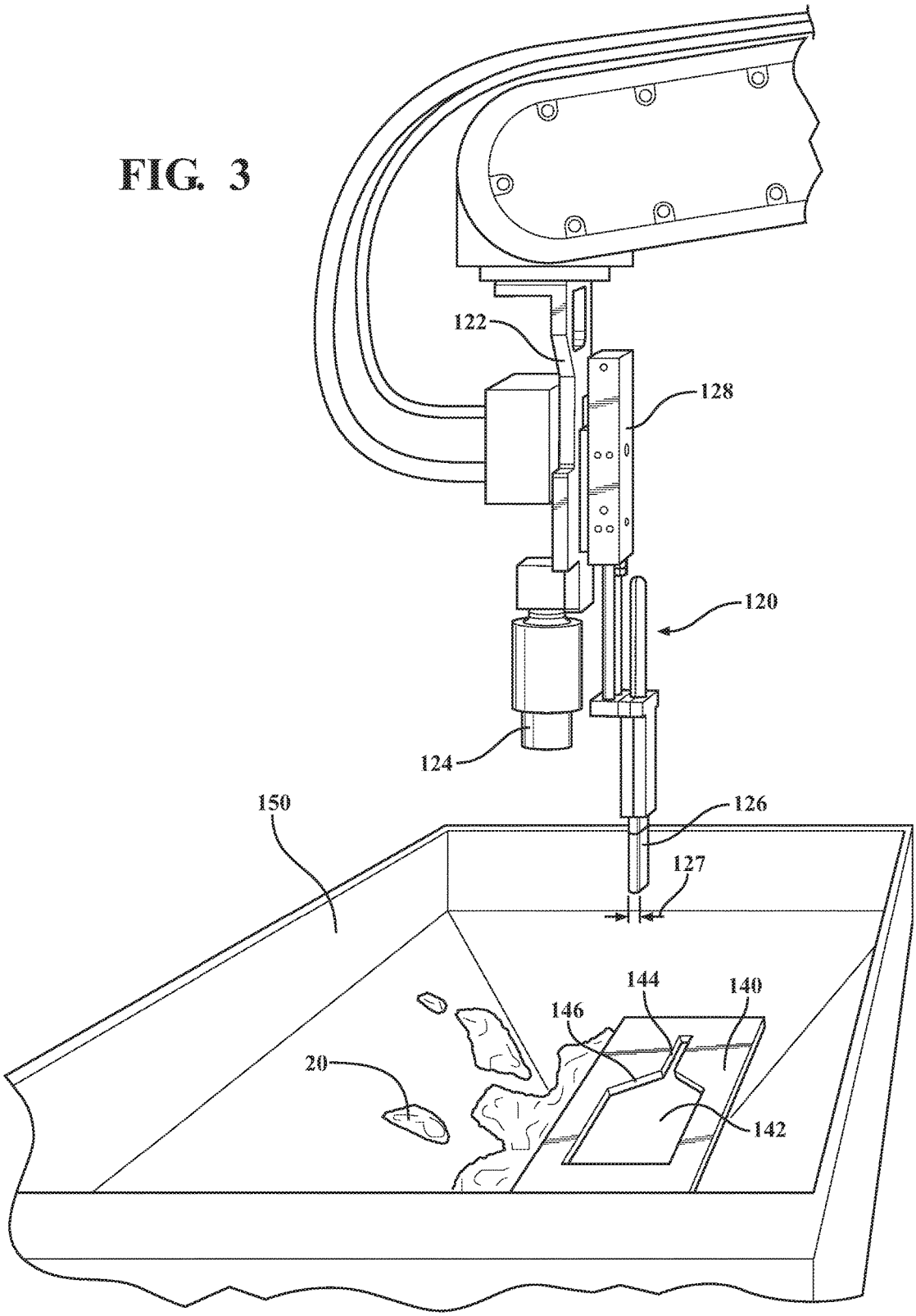
FIG. 3 shows the coating system of FIG. 1 with a brush cleaning tool.
Figure 4:
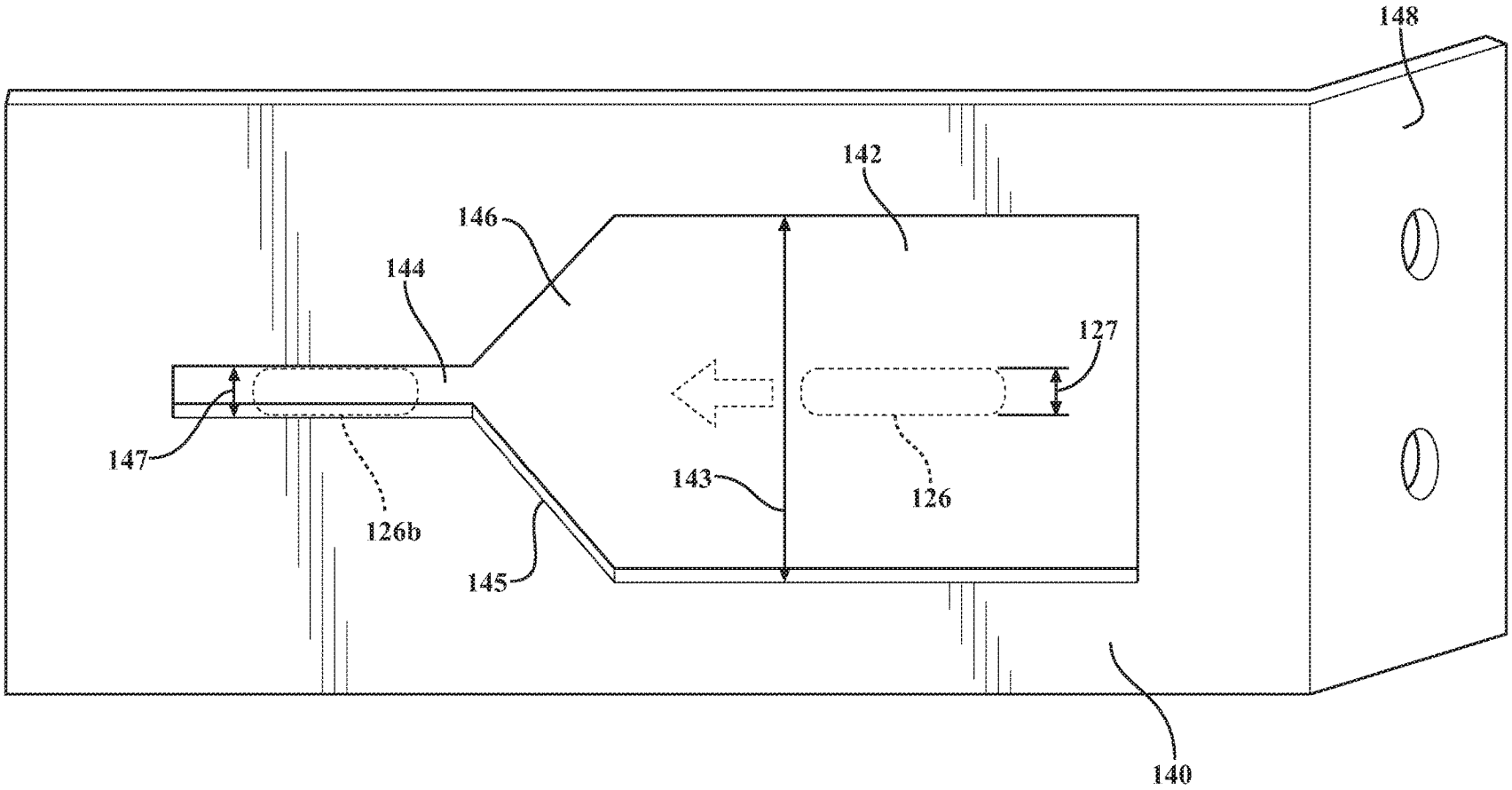
FIG. 4 shows an example of the brush cleaning tool of FIG. 3.

In one or more arrangements, the system 100 can include elements to allow for the automated cleaning of the brush 126. Referring now to FIGS. 3 and 4, the brush 126, a cleaning tool 140 and a collection unit 150 can be described. As a result of brushing the coating 16 on the workpiece 12, some of the coating may attach to, and remain on, the brush 126. The cleaning tool 140 can be used to remove some of this "left-over," or excess coating 20.

In one or more arrangements, the cleaning tool 140 can allow the brush 126 to be cleaned from movement of the brush 126 relative to the cleaning tool 140. For instance, the brush 126 can be moved within the cleaning tool 140 such that the excess coating 20 and/or the brush 126 contacts portions of the cleaning tool 140. This can cause the excess coating 20 to be scraped away from the brush 126.

As shown in FIGS. 3 and 4, the cleaning tool 140 can include a structure having one or more openings, apertures, slots, and/or grooves. In the non-limiting example shown in the Figures, the cleaning tool 140 can define an opening having a first region 142, a second region 144, and a middle region 146. The first region 142 can be relatively large to receive at least a portion of the brush 126. The first region 142 can have a width 143 that is greater than a width 127 of the brush 126.

In one or more arrangements, the opening in the cleaning tool 140 can have a tapered middle region 146. For example, the tapered middle region 146 can be partially defined by tapered sides 145. A width between the tapered sides 145 can decrease as distance from the first region 142 increases.

In one or more arrangements, the second region 144 can have a smaller width 147 than the width 143 of the first region. The second region 144 can be partially defined by substantially parallel sides as shown in FIG. 4. Alternatively, the sides can be tapered in at least a portion of the second region 144.

In one or more arrangements, the brush 126 can be inserted at least partially through the opening in the cleaning tool 140 during cleaning. For example, as shown in FIG. 4, the free end of a brush **126*a* is shown within the first region 142 of the opening (in broken lines). While the free end is inserted into the opening, the brush 126 can be moved within the opening of the cleaning tool 140. For example, the brush 126 can be moved from the first region 142, through the middle region 146, and into the second region 144. A brush 126*b* is shown within the second region 144 (in broken lines). The brush 126 can then be removed from the second region 144**.

In one or more arrangements, the width 147 of the second region 144 can be close to the width 127 of the brush 126. For example, the width 147 can be slightly larger, slightly smaller, or substantially the same, as the width 127. As used herein, "slightly larger" can include widths that are a small percentage larger than the width 127, such as 2% larger, 5% larger, or 10% larger, as a few examples. As used herein, "slightly smaller" can include widths that are a small percentage smaller than the width 127, such as, for example, 2% smaller, 5% smaller, or 10% smaller, as a few examples. During removal of the brush 126 from the second region 144, excess coating 20 can be scraped off by the cleaning tool 140.

The system 100 can include a collection unit 150 to collect excess coating 20 that is left-over on the brush 126 after brushing. The collection unit 150 can have any suitable size, shape, and configuration. For example, the collection unit 150 can be a container with an open top as shown in FIG. 3. In some arrangements, the cleaning tool 140 can be located above the collection unit 150 to allow the excess coating 20 to fall into the collection unit 150. For example, the cleaning tool 140 can include an attachment end 148 that is operatively connected to a portion of the collection unit 150.

In one or more arrangements, the excess coating 20 can be re-used. For example, a pump (not shown) can transfer the excess coating 20 from the collection unit 150 to the nozzle 124 and/or the storage area (not shown) for the coating 16.

Figure 5:
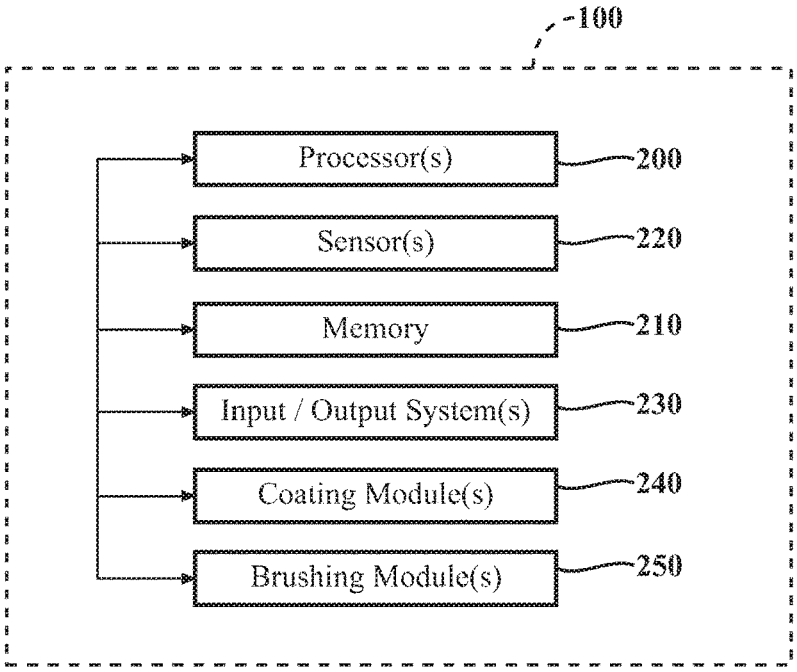
FIG. 5 shows examples of additional elements of the coating system of FIG. 1.

The system 100 can include various elements that at least partially relate to the application end 120, including one or more computing elements. Some of the possible elements of the system 100 are shown in FIG. 5 and will now be described. It will be understood that it is not necessary for the system 100 to have all of the elements shown in FIG. 5 or described herein. The system 100 can have any combination of the various elements shown in FIG. 5. Further, the system 100 can have additional elements to those shown in FIG. 5. In some arrangements, the system 100 may not include one or more of the elements shown in FIG. 5. Further, while the various elements are shown as being located within the system 100 in FIG. 5, it will be understood that one or more of these elements can be located external to the system 100. Further, the elements shown may be physically separated by large distances. In some arrangements, one or more of the elements shown in FIG. 5 can be located within the controller(s) 130 of the system 100. One or more elements shown in FIG. 5 can be operatively connected to the robot arm 110 and/or the application end 120.

The various elements can be communicatively linked through one or more communication networks. As used herein, the term "communicatively linked" can include direct or indirect connections through a communication channel or pathway or another component or system. A "communication network" means one or more components designed to transmit and/or receive information from one source to another. One or more of the elements of the system 100 can include and/or execute suitable communication software, which enables the various elements to communicate with each other through the communication network and perform the functions disclosed herein.

The system 100 can include one or more processors 200. "Processor" means any component or group of components that are configured to execute any of the processes described herein or any form of instructions to carry out such processes or cause such processes to be performed. The processor(s) 200 may be implemented with one or more general-purpose and/or one or more special-purpose processors. Examples of suitable processors include microprocessors, microcontrollers, DSP processors, and other circuitry that can execute software. The processor(s) 200 can include at least one hardware circuit (e.g., an integrated circuit) configured to carry out instructions contained in program code. In one or more arrangements, the processor(s) 200 can be located within the controller 130 of the system 100.

The system 100 can include memory 210 for storing one or more types of data. The memory 210 can include volatile and/or non-volatile memory. Examples of suitable memory 210 include RAM (Random Access Memory), flash memory, ROM (Read Only Memory), PROM (Programmable Read-Only Memory), EPROM (Erasable Programmable Read-Only Memory), EEPROM (Electrically Erasable Programmable Read-Only Memory), registers, magnetic disks, optical disks, hard drives, or any other suitable storage medium, or any combination thereof. The memory 210 can be a component of the processor(s) 200, or the memory 210 can be operatively connected to the processor(s) 200 for use thereby.

The system 100 can include one or more sensors 220. "Sensor" means any device, component and/or system that can detect, determine, assess, monitor, measure, quantify and/or sense something. The one or more sensors can detect, determine, assess, monitor, measure, quantify and/or sense in real-time. As used herein, the term "real-time" means a level of processing responsiveness that a user or system senses as sufficiently immediate for a particular process or determination to be made, or that enables the processor to keep up with some external process.

In one or more arrangements, the sensor(s) 220 can sense the presence and/or the quality of an applied coating 16. For instance, data acquired by the sensor(s) 220 can be used to determine whether the coating 16 is present in one or more areas on the workpiece 12. For example, the sensor(s) 220 can sense one or more gaps in coverage of the coating 16. Alternatively or in addition, the data acquired by the sensor(s) 220 can be used to determine if the quality of the coating 16 meets applicable criteria in one or more areas on the workpiece. For example, the sensor(s) 220 can sense the amount of coating 16, which can be used to determine if too much or too little coating 16 has been applied in one or more areas on the workpiece.

The sensor(s) 220 can include any suitable sensor to sense the presence and/or the quality of the coating 16. For example, the sensor(s) 220 can include a vision system that includes one or more cameras. Alternatively or in addition, the sensor(s) 220 can include infra-red (IR) light sensors, lasers, conductivity sensors, and/or physical sensors.

The system 100 can include one or more input/output systems 230. An "input system" includes any device, component, system, element or arrangement or groups thereof that enable information/data to be entered into a machine. The input system can be configured to receive an input from a user. An "output system" includes any device, component, system, element or arrangement or groups thereof that enable information/data to be presented to a vehicle occupant (e.g. a person, a vehicle occupant, etc.). The output system can be configured to present information/data to a user. Some components of the system 100, such as the controller 130, may serve as a component of the input/output system(s) 230.

The system 100 can include one or more modules, at least some of which will be described herein. The modules can be implemented as computer readable program code that, when executed by a processor, implement one or more of the various processes described herein. One or more of the modules can be a component of the processor(s) 200, or one or more of the modules can be executed on and/or distributed among other processing systems to which the processor(s) 200 is operatively connected. The modules can include instructions (e.g., program logic) executable by one or more processor(s) 200. Alternatively or in addition, the memory 210 may contain such instructions.

In one or more arrangements, one or more of the modules described herein can include artificial or computational intelligence elements, e.g., neural network, fuzzy logic or other machine learning algorithms. Further, in one or more arrangements, one or more of the modules can be distributed among a plurality of the modules described herein. In one or more arrangements, two or more of the modules described herein can be combined into a single module.

The system 100 can include one or more coating modules 240. The coating module(s) 240 can be configured to perform various functions, particularly functions relating to the dispensing of the coating 16 to a workpiece 12. In one or more arrangements, the coating modules 240 can be configured to cause movement of the application end 120. As used herein, "cause" or "causing" means to make, force, compel, direct, command, instruct, and/or enable an event or action to occur or at least be in a state where such event or action may occur, either in a direct or indirect manner. The movement can be based on predetermined, or pre-programmed, information about the workpiece 12. For example, position data can be stored in the coating module(s) 240 and/or memory 210 that includes areas in which the application end 120 and the nozzle(s) 124 can be moved to and from.

The coating module(s) 240 can be configured to cause the coating 16 to be dispensed onto the workpiece 12. For example, the coating module(s) 240 can cause the coating 16 to be dispensed through the nozzle(s) 124 as the application end 120 is moved. The dispensing can be based on predetermined, or pre-programmed, information about the workpiece 12. For example, position data can be stored in the coating module(s) 240 and/or memory 210 that includes areas in which the coating 16 should be dispensed. The position data can include the location of seams between two components of the workpiece 12.

In some arrangements, the coating modules 240 can use data acquired by the sensor(s) 220 to determine areas of the workpiece 12 in which the coating 16 should be dispensed.

The system 100 can include one or more brushing modules 250. The brushing module(s) 250 can be configured to perform various functions, particularly functions relating to the brushing of the coating 16 and/or the workpiece 12. In one or more arrangements, the brushing modules 250 can be configured to cause movement of the application end 120. The movement can be based on predetermined, or pre-programmed, information about the workpiece 12. For example, position data can be stored in the brushing module(s) 250 and/or memory 210 that includes areas in which the application end 120 and the brush 126 can be moved to and from.

The brushing module(s) 250 can be configured to cause the brush 126 to brush the coating 16 dispensed onto the workpiece 12. In one or more arrangements, this can include causing the brush 126 to move between a retracted position and a deployed position. For example, the bushing module(s) 250 can cause the actuator(s) 128 to move the brush 126 into the deployed position.

The brushing module(s) 250 can cause the brush 126 to move such that the brush 126 comes into, or remains in, contact with the coating 16 and/or the workpiece 12. The brushing can be based on predetermined, or pre-programmed, information about the workpiece 12. For example, position data can be stored in the brushing module(s) 250 and/or memory 210 that includes areas in which the coating 16 should be brushed. The position data can include particular areas in which the coating 16 is known not to be adequately dispensed to the workpiece 12.

In some arrangements, the brushing modules 250 can use data acquired by the sensor(s) 220 to determine areas of the workpiece 12 in which the coating 16 should be brushed. For example, the sensor(s) 220 can determine areas on the workpiece 12 in which there is either not enough or too much coating 16 present.

Now that the various potential systems, devices, elements and/or components of the system 100 have been described, various methods will now be described. Various possible steps of such methods will now be described. The methods described may be applicable to the arrangements described above in relation to FIGS. 1-5, but it is understood that the methods can be carried out with other suitable systems and arrangements. Moreover, the methods may include other steps that are not shown here, and in fact, the methods are not limited to including every step shown. The blocks that are illustrated here as part of the methods are not limited to the particular chronological order. Indeed, some of the blocks may be performed in a different order than what is shown and/or at least some of the blocks shown can occur simultaneously.

Figure 6:
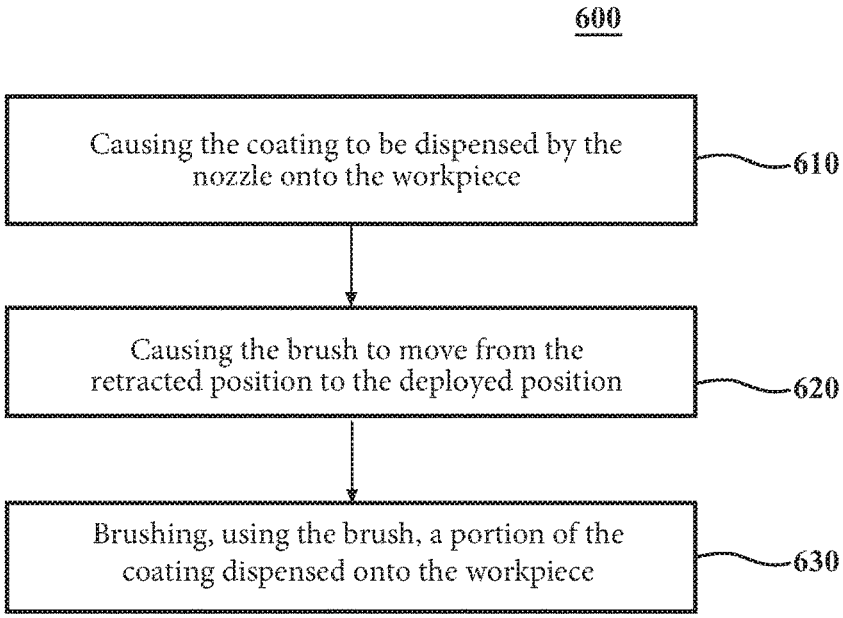
FIG. 6 is an example of a method for applying a coating to a workpiece.

Referring now to FIG. 6, an example of a method 600 for the automatic application of a coating to a workpiece is shown. At block 610, a coating can be caused to be dispensed by the nozzle onto the workpiece. The coating can be any suitable coating and can include, for example, a UBC. The coating 16 can be dispensed through the nozzle 124. The nozzle 124 can be moved by the robot arm 110. In some arrangements, the coating 16 can be caused to be dispensed automatically in response to signals generated by the controller(s) 130. The method 600 can continue to decision block 620.

At decision block 620, the brush can be caused to move from the retracted position to the deployed position. In some arrangements, the causing can be done automatically by the actuator(s) 128 in response to signals generated by the controller(s) 130. The method 600 can continue to decision block 630.

At decision block 630, a portion of the coating dispensed onto the workpiece is brushed. In one or more arrangements, the brushing can be done by the brush 126. The brush 126 can be moved by the robot arm 110. In some arrangements, the coating 16 can be brushed automatically in response to signals generated by the controller(s) 130. The method 600 can end. Alternatively, the method 600 can return to block 610 or some other block.

A non-limiting example of the operation of the system 100 will now be described. In this example, the system 100 can be located within the manufacturing station 10. Also within the station 10 can be the workpiece 12. In some arrangements, the station 10 can be a station within an assembly plant, and the workpiece 12 can be an underbody assembly for a vehicle.

The system 100 can include the robot arm 110, the application end 120, the controller 130, and/or the cleaning tool 140. The robot arm 110 can be any robot that allows the application end to be moved such that the nozzle 124 and/or the brush 126 can access different areas of the workpiece 12.

The application end 120 can include the base 122 that is operatively connected to the robot arm 110, the nozzle 124, and the brush 126. The nozzle 124 can be configured to dispense a coating 16. In some arrangements, the coating 16 is a UBC that can be dispensed onto the workpiece 12 which can be an underbody assembly. The controller 130 can cause the robot arm 110 and the nozzle 124 to automatically dispense the coating 16 onto the workpiece 12. For instance, the controller 130 can cause the coating 16 to be dispensed onto one or more seams of the underbody assembly.

The controller 130 can be configured to cause brushing of the coating 16 dispensed onto the workpiece 12. The brush 126 can first be moved from a retracted position to a deployed position. The brush 126 can then be caused to move, via the robot arm and/or the controller 130, such that it contacts a portion of the coating 16 dispensed onto the workpiece 12. The brushing can occur at predetermined portions of the workpiece 12. For instance, the controller 130 can include position data for particular areas of the workpiece 12 to be brushed. Alternatively or in addition, the brushing can occur at areas based on data acquired from the one or more sensors 220. For example, data acquired from the sensor(s) 220 can be used to determine that one or more areas of the workpiece 12 has too much or too little coating 16.

The brush 126 can be passed through the cleaning tool 140. In some arrangements, the cleaning tool 140 includes an opening having different sized regions. For example, the brush 126 can be inserted through the opening in the first region 142. The brush 126 can then be moved through the middle region 146 and into the second region 144. The brush 126 can be removed from the second region 144 of the opening. Based on the configuration of the brush 126 and the opening of the cleaning tool 140, excess coating 20 can be removed from the brush 126. The excess coating 20 can be collected in the collection unit 150 for re-use.

It will be appreciated that arrangements described herein can provide numerous benefits, including one or more of the benefits mentioned herein. For example, the unique application ends can include both a nozzle to dispense a coating and a brush to brush the dispensed coating. Such features can reduce complexity within manufacturing systems. Further, the unique application ends can allow for the brush to be moved between a retracted position that allows uninhibited dispensing of the coating from the nozzle and a deployed position that allows the brush to access areas of a workpiece. Arrangements described herein can decrease the time needed for coating application. For example, required manual brushing can be reduced and/or eliminated. The operation of dispensing, brushing, and cleaning can be automated by one or more computing elements and robots. Arrangements that include automated cleaning of the brush can extend the system's run time by, for example, reducing and/or eliminating downtime required for system maintenance.

The flowcharts and block diagrams in the figures illustrate the architecture, functionality, and operation of possible implementations of systems, methods and computer program products according to various embodiments. In this regard, each block in the flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The systems, components and/or processes described above can be realized in hardware or a combination of hardware and software and can be realized in a centralized fashion in one processing system or in a distributed fashion where different elements are spread across several interconnected processing systems. Any kind of processing system or other apparatus adapted for carrying out the methods described herein is suited. A typical combination of hardware and software can be a processing system with computer-usable program code that, when being loaded and executed, controls the processing system such that it carries out the methods described herein. The systems, components and/or processes also can be embedded in a computer-readable storage, such as a computer program product or other data programs storage device, readable by a machine, tangibly embodying a program of instructions executable by the machine to perform methods and processes described herein. These elements also can be embedded in an application product which comprises all the features enabling the implementation of the methods described herein and, which when loaded in a processing system, is able to carry out these methods.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The phrase "at least one of . . . and . . . " as used herein refers to and encompasses any and all possible combinations of one or more of the associated listed items. As an example, the phrase "at least one of A, B and C" includes A only, B only, C only, or any combination thereof (e.g., AB, AC, BC or ABC).

Aspects herein can be embodied in other forms without departing from the spirit or essential attributes thereof. Accordingly, reference should be made to the following claims, rather than to the foregoing specification, as indicating the scope of the invention.

What is claimed is:

1. A device to apply a coating to a workpiece, the device comprising:

a robot arm having one or more joints, the joints configured to allow rotational and/or translational movement, the robot arm comprising:

an application end having a base;

a nozzle operatively connected to the base, the nozzle configured to dispense the coating onto the workpiece;

an actuator operatively connected to the base; and a brush connected to the actuator, the brush configured to brush a portion of the coating dispensed onto the workpiece, wherein the actuator is configured to rotate the brush relative to the base, and wherein the actuator is configured to move the brush between a retracted position and a deployed position in a direction that is substantially linear and substantially parallel to a longitudinal axis of the nozzle, the brush being positioned farther away from the nozzle in the deployed position than in the retracted position.

2. The device of claim 1, further including the nozzle being in fluid communication with one or more conduits.

3. The device of claim 1, further comprising a cleaning tool configured to remove an excess coating on the brush after brushing the portion of the coating dispensed onto the workpiece.

4. The device of claim 3, wherein the cleaning tool defines an opening having a first region with a first width and a second region with a second width, the first width being larger than the second width, and wherein removing the excess coating on the brush includes inserting a portion of the brush into the first region of the opening, moving the portion of the brush into the second region, and removing the portion of the brush from the second region of the opening.

5. The device of claim 4, wherein the second width is sized such that at least one of the portion of the brush and the excess coating on the brush directly contacts the cleaning tool when the portion of the brush is removed from the second region of the opening.

6. The device of claim 4, wherein the robot arm is configured to pass the brush from the first region to the second region of the cleaning tool.

7. A system to apply a coating to a workpiece, the system comprising:

a robot arm comprising:

an application end having a base and operatively connected to the robot arm;

a nozzle connected to the base, the nozzle configured to dispense the coating onto the workpiece;

an actuator connected to the base; and a brush connected to the actuator, the brush configured to brush a portion of the coating dispensed onto the workpiece, wherein the actuator is configured to rotate the brush relative to the base, and wherein the actuator is configured to move the brush between a retracted position and a deployed position;

one or more processors;

one or more sensors communicably coupled to the one or more processors; and a memory communicably coupled to the one or more processors and storing:

a coating module including instructions that when executed by the one or more processors cause the one or more processors to determine, using the one or more sensors, areas of the workpiece in which coating should be dispensed, and to cause coating to be dispensed through the nozzle; and a brushing module including instructions that when executed by the one or more processors cause the one or more processors to cause the brush, through the actuator, to move between a retracted position and a deployed position, the brush being positioned farther away from the nozzle in the deployed position than in the retracted position, to determine areas of the workpiece in which the coating should be brushed, and to cause the brush to brush the coating dispensed onto the workpiece.

8. The system of claim 7, wherein the actuator is configured to move the brush between the retracted position and the deployed position in a direction that is substantially linear and substantially parallel to a longitudinal axis of the nozzle.

9. The system of claim 7, wherein the actuator is a linear pneumatic actuator.

10. The system of claim 7, further comprising a processor communicatively linked to the actuator and the robot arm, the processor being configured to:

cause the robot arm to move the application end and to cause the nozzle to dispense the coating onto the workpiece; and cause the actuator to move the brush between the retracted position and the deployed position after dispensing the coating onto the workpiece, the processor further configured to cause the robot arm to move the application end.

11. The system of claim 7, wherein the brushing module further comprises instructions to cause the brush to pass through a cleaning tool.

12. The system of claim 7, wherein the system further comprises:

the one or more sensors configured to acquire data relating to an amount of coating dispensed onto the workpiece, wherein the brushing of the portion of the coating dispensed onto the workpiece is based on the acquired data.

13. The system of claim 7, further comprising a cleaning tool configured to remove an excess coating on the brush after brushing the portion of the coating dispensed onto the workpiece, wherein the cleaning tool is located in proximity to the robot arm such that the brush is movable into contact with the cleaning tool by the robot arm.

14. The system of claim 13, wherein the cleaning tool defines an opening having a first region with a first width and a second region with a second width, the first width being larger than the second width, and wherein removing the excess coating on the brush includes inserting a portion of the brush into the first region of the opening, moving the portion of the brush into the second region, and removing the portion of the brush from the second region of the opening.

15. The system of claim 14, wherein the second width is sized such that at least one of the portion of the brush and the excess coating on the brush directly contacts the cleaning tool when the portion of the brush is removed from the second region of the opening.

16. The system of claim 14, wherein the robot arm is configured to pass the brush from the first region to the second region of the cleaning tool.

17. The system of claim 7, further comprising one or more joints, the joints configured to allow rotational and/or translational movement of the robot arm.

* * * * *